United States Patent [19]

Coons

[11] 4,094,459

[45] June 13, 1978

[54] CONTAINER WITH EASY TUCK-UNDER FLAP FOR OVERLAPPING CLOSURE AND METHOD

[75] Inventor: Everett A. Coons, West Monroe, La.

[73] Assignee: Olinkraft, Inc., West Monroe, La.

[21] Appl. No.: 859,672

[22] Filed: Dec. 12, 1977

[51] Int. Cl.[2] ..... B65D 5/10; B65D 5/02

[52] U.S. Cl. ..... 229/41 B; 229/39 B

[58] Field of Search ..... 229/41 R, 41 B, 39 R

[56] References Cited

U.S. PATENT DOCUMENTS

| | | | |
|---|---|---|---|
| 2,513,079 | 6/1950 | Buerger | 229/41 B |
| 2,702,154 | 2/1955 | Linson | 229/41 B X |
| 2,713,074 | 11/1955 | Wagner, Jr. | 229/41 B |
| 2,861,734 | 11/1958 | Garman | 229/41 B |
| 2,898,029 | 8/1959 | Sherman | 229/41 B |
| 3,517,875 | 6/1970 | Wakefield | 229/41 B X |
| 3,542,282 | 11/1970 | Troth | 229/38 |
| 3,927,824 | 12/1975 | Razziano | 229/41 B X |
| 3,960,313 | 6/1976 | Sax et al. | 229/41 B |
| 4,007,869 | 2/1977 | Stolkin | 229/39 R X |

*Primary Examiner*—Davis T. Moorhead
*Attorney, Agent, or Firm*—O'Brien & Marks

[57] ABSTRACT

A reverse folding portion of a fold-down portion of one flap is hinged for being bent reversibly relative to the fold-down portion during insertion of the fold-down portion under an adjacent flap to produce locking of the closure flaps with overlapping corners of adjacent closure flaps.

12 Claims, 15 Drawing Figures

CONTAINER WITH EASY TUCK-UNDER FLAP FOR OVERLAPPING CLOSURE AND METHOD

BACKGROUND OF THE INVENTION

1. Field of the Invention

This invention relates to containers having self-locking closures formed by flaps with corners tucked under or overlapping adjacent flaps.

2. Description of the Prior Art

One prior art closure in a regular slotted container of corrugated paperboard includes four trapezoidal closure flaps hinged at the longest of their respective two parallel edges to the top edges of the walls of the container. Each of the closure flaps has one side edge, i.e. one of the non-parallel edges, perpendicular to the parallel edges, and has the other side edge formed at a 45° angle to the longest parallel edge. The closure flaps are folded sequentially with a portion of each closure flap adjacent the 45° angled edge overlapping a portion or corner adjacent the perpendicular edge of the previously folded flap. One of the flaps, i.e., the last flap to be closed, has a slot extending from its perpendicular side edge about one fifth of the distance along its longest parallel edge in line with the scoreline joining such flap to the container together with a scoreline extending from the inside end of the slot at a 45° angle across the flap to the 45° angled edge of the flap. This slot and 45° score line permits the corner portion adjacent the perpendicular side edge of this last flap to be resiliently folded down and inserted into the containers under the 45° angled edge of the adjacent flap to complete the closure so that the flaps are locked together. However, it is difficult to use this type of closure when the container is full of non-compressible materials since the non-compressible materials prevent the fold-down corner portion from being inserted into the container sufficiently to make the proper closure. Also distortion or deformation of the flap portion being tucked under the adjacent flap often occurs rendering the container less suitable for further use.

SUMMARY OF THE INVENTION

The invention is summarized in a container blank including a plurality of side panels serially hinged together so that the side panels can be folded to form an enclosed wall for a container, a joint flap on one end panel of the side panels for being secured to the other end panel of the side panels to form the enclosed wall, bottom means attached to the bottom edges of the side panels for closing the bottom of the container, a plurality of trapezoidal closure flaps each having the longer of the two parallel edges thereof hinged to the top edge of the respective side panel, the closure flaps having dimensions for being sequentially folded together so that one side portion bordered by one of the non-parallel edges of each closure flap is overlapped by another side portion bordered by the other non-parallel edge of an adjacent flap, one of the closure flaps having a slit extending along a segment of the longer parallel edge thereof from the one non-parallel edge thereof to an inner end of the slit, the one closure flap also having a first scoreline extending across the one closure flap from the inner end of the slit at an acute angle relative to the longer parallel edge thereof toward the other non-parallel edge thereof to form a fold-down portion between the first scoreline and the one non-parallel edge thereof to permit the one side portion of the one closure flap to be inserted beneath the another side portion of the corresponding adjacent closure flap, and the one closure flap having a second scoreline extending from the slit across the fold-down portion intermediate the first scoreline and the one non-parallel edge of the one closure flap to define a reverse folding portion between the second scoreline and the one non-parallel edge for being reverse folded relative to the remaining portion of the fold-down portion to substantially reduce the extent of protrusion of the fold-down portion into the container during insertion of the one side portion of the one closure flap beneath the another side portion of the corresponding adjacent closure flap.

An object of the invention is to construct a container with a manually closeable secured top with easy opening and reclosure and having knock-down capability.

Another object of the invention is to construct an improved container with top closure flaps for being interlocked by overlapping corner portions thereof wherein the last overlapped portion can be easily inserted beneath the corresponding adjacent flap without substantial extension into the center of the container.

It is yet another object of the invention is to eliminate breaking or weakening of an overlapped portion of the last closure flap during insertion beneath the corresponding adjacent closure flap.

A further object of the invention is to construct a container having a locking top suitable for accommodating a variety of package contents including those resulting in slight bulging in the top and bottom.

A still further object of the invention is to provide an alternative self-locking container to the presently employed regular slotted container.

One advantage of the invention is that a corner portion can be inserted beneath the adjacent flap even when the container is full without breaking or bending the corner flap except along its existing scorelines.

Other objects, advantages and features of the invention will be apparent from the following description of the preferred embodiment, taken in conjunction with the accompanying drawings.

DESCRIPTION OF THE PREFERRED EMBODIMENT

Figure 1:
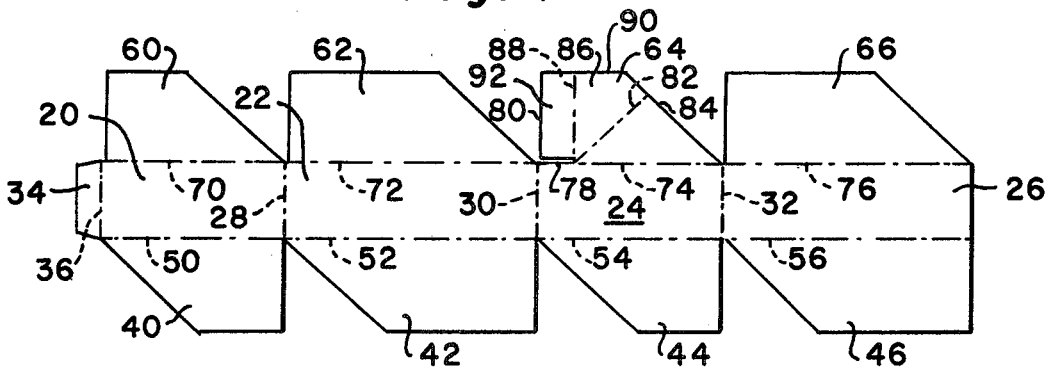
FIG. 1 is a plan view of a blank for forming a container in accordance with the invention.

One embodiment of the invention is formed from a single blank of corrugated paperboard or the like illustrated in FIG. 1 for forming a container. The blank includes side wall panels 20, 22, 24 and 26 which are serially hinged together by a scoreline 28 between the panels 20 and 22, a scoreline 30 between the panels 22 and 24 and a scoreline 32 between the panels 24 and 26. A joint flap 34 is hinged at a scoreline 36 on the end panel 20 for being secured to the opposite end panel 26 to form an enclosed wall for the container. The container blank also includes conventional bottom means, such as trapezoidal bottom flaps 40, 42, 44 and 46 hinged at scorelines 50, 52, 54 and 56 on the bottom edges or ends of the respective side wall panels 20, 22, 24 and 26 for closing the bottom end of the container. A top closure for the container includes closure flaps 60, 62, 64 and 66 which are formed in a trapezoidal shape and which are hinged at scorelines 70, 72, 74 and 76 on the top edges or ends of the respective panels 20, 22, 24 and 26 for closing the top end of the container. It is noted that the scorelines 70, 72, 74 and 76 extend along the longer edge of the two opposite parallel edges of the respective trapezoidal flaps 60, 62, 64 and 66, and that one of the non-parallel edges of each of the flaps 60, 62, 64 and 66 is perpendicular to the parallel edges of the flaps 60, 62, 64 and 66; such perpendicular non-parallel edges being on the same side of the respective flaps 60, 62, 64 and 66 in the blank as shown in FIG. 1. Additionally, it is noted that the flap 64 includes a cut or slit 78 extending for a short distance along the longer parallel edge of the flap 64 in line with the scoreline 74 from the perpendicular non-parallel edge 80 of the flap 64. The slit 78 can be of various lengths proportionate to the container length and width dimensions. It is preferred that the slit 78 has a length approximately one-fifth the length of the longer parallel edge of the flap 64. Alternately it is preferred to make the length of the slit 78 in the range of 3.175 to 6.35 centimeters (1.25 to 2.5 inches) long. A scoreline 82 extends across the flap 64 from the inner end of the slit 78 at an acute angle to the scoreline 74 toward the non-perpendicular non-parallel edge 84 of the trapezoidal flap 64. The scoreline 82 is preferred to extend at an angle approximately 45° to the scoreline 74. The scoreline 82 and the cut 78 define a fold-down portion 86 of the flap 64 between the scoreline 82 and the perpendicular non-parallel edge 80. As described above in the description of the prior art, closures for containers including trapezoidal flaps wherein one flap has a slit similar to slit 78 and a scoreline similar to scoreline 82 for forming a fold-down portion similar in dimensions to the fold-down portion 86 are well known.

Figure 12:
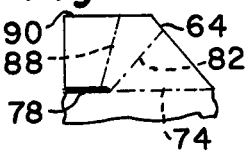
FIG. 12 is a plan view of a modification of one closure flap of the blank of FIG. 1.
Figure 13:
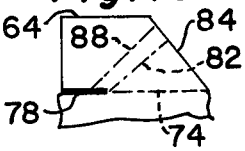
FIG. 13 is a plan view of a second modification of one closure flap of the blank of FIG. 1.
Figure 14:
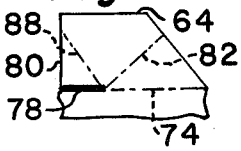
FIG. 14 is a plan view of a third modification of one closure flap of the blank of FIG. 1.
Figure 15:
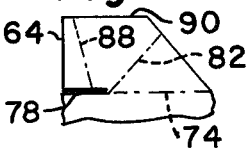
FIG. 15 is a plan view of a fourth modification of one closure flap of the blank of FIG. 1.

The present invention differs from the prior art in the inclusion of a scoreline 88 which extends from the slot 78 to the shorter parallel edge 90 across the fold-down portion 86 intermediate the scoreline 82 and the edge 80 so as to form a reverse folding portion 92 between the scoreline 88 and the edge 80. The scoreline 88 can be a regular score permitting reverse folding, a reverse score, or a perforated score. In the embodiment of FIG. 1, the scoreline 88 is shown to extend from the inner end of the cut 78 at the intersection of the cut 78 and scoreline 82 across the fold-down portion 86 perpendicular to scoreline 74. In a variation shown of FIG. 12, the scoreline 88 extends from an intermediate or center point of the cut 78 at an acute angle, for example 72°, relative to the scoreline 74; such acute angle being greater than the angle formed by the scoreline 82 relative to the scoreline 74. In FIG. 13, the angle of the scoreline 88 relative to score-line 74 is substantially closer to the angle of the scoreline 82 so that the scoreline 88 extends to the non-parallel edge 84 spaced from the scoreline 82. In variations of FIGS. 14 and 15, the angle of the scoreline 88 is obtuse relative to the scoreline 74; the line 88 in FIG. 14 extending to the perpendicular non-parallel side 80 while in FIG. 15 the scoreline 88 extends to the shorter parallel side 90 on the flap 64.

The top closure with the top flaps 60, 62, 64 and 66 wherein one top flap 64 includes the cut 78 and scorelines 82 and 88 is suitable for use on square or rectangular containers as well as other multipanel containers with three or more sides.

Figure 2:
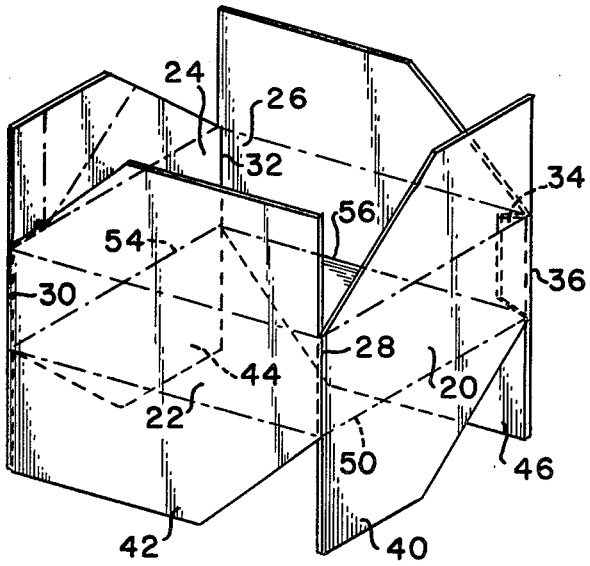
FIG. 2 is a perspective view taken toward an upper corner of a partially assembled container from the container blank of FIG. 1.
Figure 3:
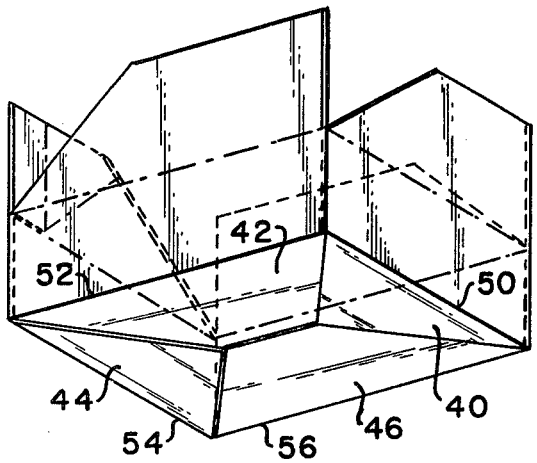
FIG. 3 is a perspective view taken toward a bottom corner of a partially assembled container from the container blank of FIG. 1 after the bottom has been assembled.

In FIGS. 2–11 there is illustrated a sequence of the steps used in assembling the container blank of FIG. 1 into a container. As shown in FIG. 2 the wall panels 20, 22, 24 and 26 are folded or bent about the scorelines 28, 30, and 32 to bring the wall panels 20, 22, 24 and 26 into a rectangular configuration. The joint flap 34 is bent about the score line 36 and overlapped with the wall panel 26 and secured thereto by suitable means, such as glue. Then the bottom flaps 42, 44, 46 and 40 are sequentially folded about the scorelines 52, 54, 56 and 50 over the bottom of the container and into the inside of the container so that the corner of the flap 40 on its non-parallel perpendicular edge maybe inserted underneath the flap 42 thus producing a locked bottom closure by means of the angled non-parallel sides of the bottom flaps overlapping the square corners of the adjoining flaps, FIG. 3.

Figure 4:
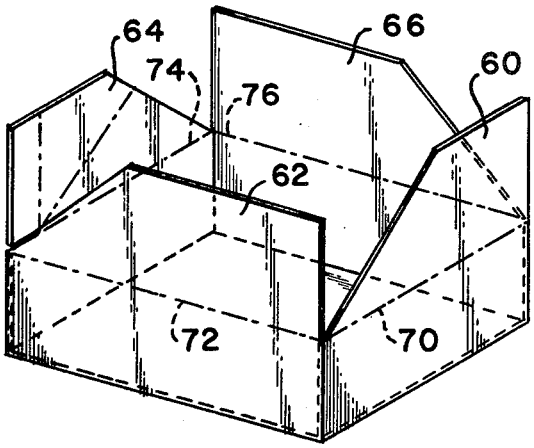
FIG. 4 is a perspective view taken toward an upper corner of the partially assembled container of FIG. 3.
Figure 5:
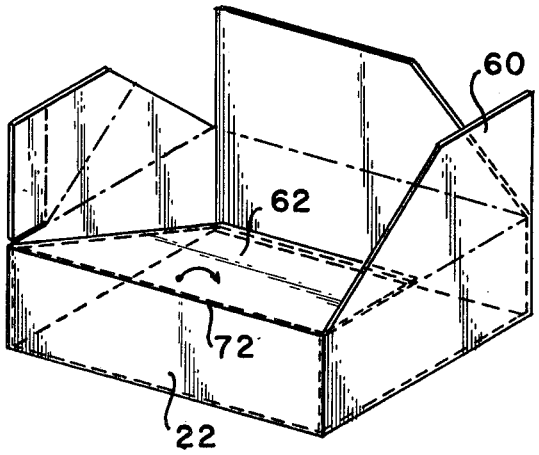
FIG. 5 is a view similar to FIG. 4 but after a first step of the assembly of the top closure of the container.
Figure 6:
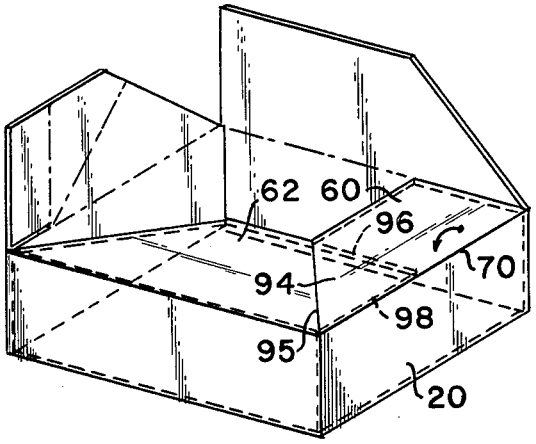
FIG. 6 is a view similar to FIGS. 4 and 5 but after a second step of the assembly of the top closure.
Figure 7:
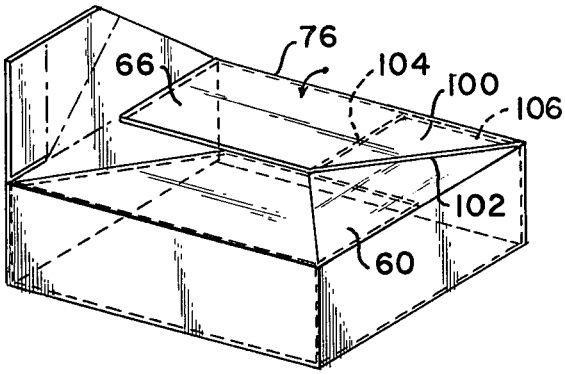
FIG. 7 is a view similar to FIGS. 4–6 but after a third step in the assembly of the top closure.
Figure 8:
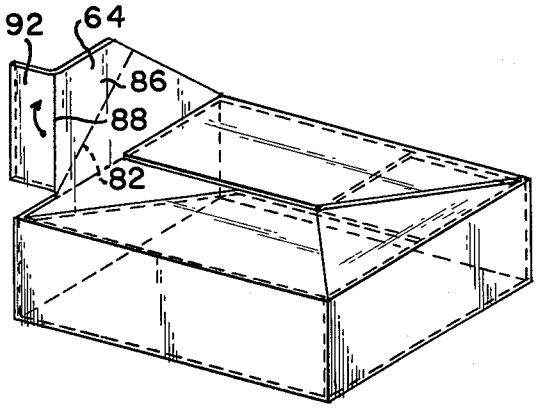
FIG. 8 is a prospective view similar to FIGS. 4–7 but after a fourth step in the assembly of the top closure.
Figure 9:
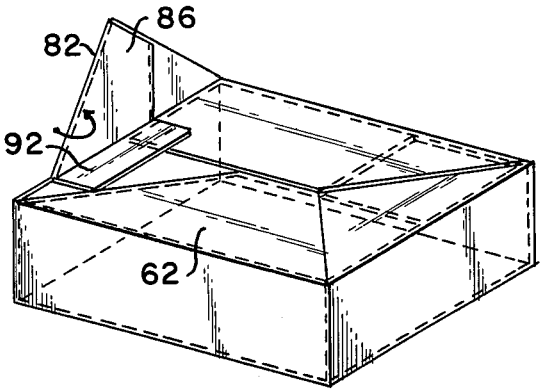
FIG. 9 is a perspective view similar to FIGS. 4–8 but after a fifth step in the assembly of the top closure.
Figure 10:
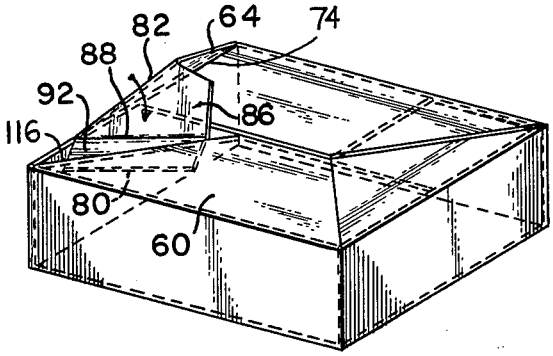
FIG. 10 is a perspective view similar to FIGS. 4–9 but taken during the final step in the assembly of the top closure.
Figure 11:
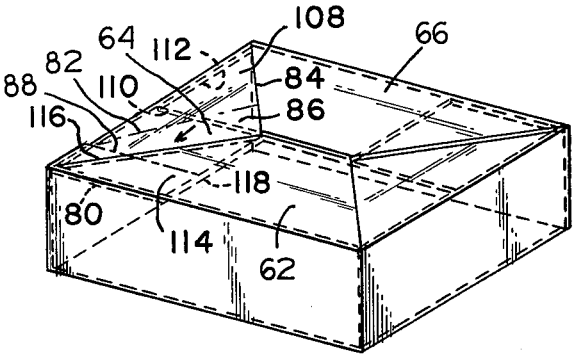
FIG. 11 is a perspective view similar to FIGS. 4–10 but after completion of the assembly of the top closure.

With the flaps 60, 62, 64 and 66 initially extending vertically as shown in FIG. 4, the top closure of the container is assembled by folding the flaps 62, 60 and 66 sequentially in the named order, as shown in FIGS. 5, 6, and 7 so that portions 94 and 100 of the flaps 60 and 66 adjacent the non-perpendicular non-parallel edges 95 and 102 of the flaps 60 and 66 overlap portions 96 and 104 of the flaps 62 and 60 adjacent the perpendicular non-parallel edges 98 and 106 of the flaps 62 and 60. Then as shown in FIG. 8 the reverse-folding portion 92 is bent back along the scoreline 88 relative to the rest of the fold-down portion 86, and the fold-down portion 86 is bent down about the scoreline 82 as shown in FIG. 9. Subsequently as shown in FIG. 10, the flap 64 is bent about the scoreline 74 toward the top of the container while the edge 80 and the reverse-folding portion 92 are guided or tucked underneath the non-perpendicular non-parallel edge 116 of the panel 62. Continued downward folding of the flap 64 as shown in FIG. 11 results in the unfolding of the fold-down portion 86 as well as the unfolding of the reverse folded portion 92 until a portion 108 of the flap 64 adjacent to the edge 84 overlaps the square corner or portion 110 of the flap 66 adjacent to the perpendicular non-parallel edge 112 of the flap 66 and until a portion 114 of the flap 62 adjacent to its non-perpendicular non-parallel edge 116 overlaps the square corner or portion 118 of the flap 64 adjacent the perpendicular non-parallel edge 80 of the flap 64. Thus the flaps 60, 62, 64 and 66 are locked in a closed position due to the resilience of the hinges at the scorelines 82 and 88 maintaining the flap 64 in the straight or unfolded condition.

The scoreline 88 extending across the fold-down portion 86 intermediate the scoreline 82 and the perpendicular non-parallel edge 80 of the flap 64 transforms the fold-down portion 86 into an articulated insertion tab resulting in the container closure being suitable for closing containers which are full of non-compressible material. The reverse-folded portion 92 allows the fold-down portion 86 to be inserted underneath the non-perpendicular non-parallel edge of the flap 62 without requiring any substantial extension of the fold-down portion 86 into the center of the container. The prior art closures which did not include the scoreline 88 or the reverse folding portion 92 formed thereby could not readily be closed when filled with packed materials that are noncompressible since distortion of the portion of the flap adjacent the perpendicular non-parallel edge was necessary in order to insert such portion beneath the adjacent flap; this distortion increased the difficulty of making the insertion and often produced breaking of the corrugations or distortion of the closure flaps rendering the container less suitable for reuse.

Since the present invention is subject to many modifications, variations, or changes in detail, it is intended that all matter in the foregoing description or shown in the accompanying drawings be interpreted as illustrative and not in a limiting sense.

What is claimed is

1. A container blank comprising a plurality of side panels serially hinged together so that the side panels can be folded to form an enclosed wall for a container, a joint flap on one end panel of the side panels for being secured to the other end panel of the side panels to form the enclosed wall, bottom means attached to the bottom edges of the side panels for closing the bottom of the container, a plurality of trapezoidal closure flaps each having the longer of the two parallel edges thereof hinged to the top edge of the respective side panel, said closure flaps having dimensions for being sequentially folded together so that one side portion bordered by one of the non-parallel edges of each closure flap is overlapped by another side portion bordered by the other non-parallel edge of an adjacent flap, one of the closure flaps having a slit extending along a segment of the longer parallel edge thereof from the one non-parallel edge thereof to an inner end of the slit, said one closure flap also having a first scoreline extending across the one closure flap from the inner end of the slit at an acute angle relative to the longer parallel edge thereof toward the other non-parallel edge thereof to form a fold-down portion between the first scoreline and the one non-parallel edge thereof to permit the one side portion of the one closure flap to be inserted beneath the another side portion of the corresponding adjacent closure flap, and said one closure flap having a second scoreline extending from the slit across the fold-down portion intermediate the first scoreline and the one non-parallel edge of the one closure flap to define a reverse folding portion between the second scoreline and the one non-parallel edge for being reverse folded relative to the remaining portion of the fold-down portion to substantially reduce the extent of protrusion of the fold-down portion into the container during insertion of the one side portion of the one closure flap beneath the another side portion of the corresponding adjacent closure flap.

2. A container blank as claimed in claim 1 wherein the second scoreline is formed at an angle approximately 90° to the longer parallel edge of the one closure flap.

3. A container as claimed in claim 1 wherein the second scoreline is formed at an acute angle relative to the longer parallel edge of the one closure flap toward the other non-parallel edge of the one closure flap.

4. A container blank as claimed in claim 1 wherein the second scoreline is formed at an obtuse angle relative to the longer parallel edge toward the one non-parallel edge of the one closure flap.

5. A container blank as claimed in claim 1 wherein the second scoreline extends from the inner end of the slit.

6. A container blank as claimed in claim 1 wherein the second scoreline extends from an intermediate point of the slit.

7. In a container of the type having a plurality of side panels hingedly connected together and a plurality of closure flaps formed on the side panels for closing the top and bottom of the container, the closure flaps generally being formed in a trapezoidal shape and being sequentially folded one on top of the other with the last folded closure flap having formed thereon a slit, initiating at one edge of the last folded closure flap and terminating inwardly at the initiation of a first scoreline, with the slit and first scoreline aiding in locking the last closure flap to the previous closure flap, the improvement comprising:

a second scoreline formed in the last folded flap, said second scoreline initiating on the slit and extending across the last folded flap; said second scoreline serving to form an articulated insertion tab on the last folded closure flap which aids in inserting the last folding closure flap underneath the adjacent closure flap without damaging the integrity of the closure flaps.

8. The improvement as defined in claim 7 wherein said second scoreline is formed approximately perpendicular to the slit.

9. The improvement as defined in claim 8 wherein said second scoreline is initiated at the initiation of the first scoreline.

10. A container, comprising:

(a) a plurality of side panels hingedly attached to each other, one of said side panels having formed thereon a manufacturer's joint for joining to an adjacent side panel to form a container;

(b) means, formed on one end of said side panels, for closing one end of the container;

(c) a plurality of trapezoidal shaped closure flaps having side edges and being hingedly connected to the other end of said side panels for closing the other end of the container;

(1) one of said trapezoidal shaped closure flaps having formed thereon a slit and a first scoreline, said slit initiating from a corner where two adjacent side panels are hingedly attached and terminating at the initiation of the first scoreline, said first scoreline terminating at one side edge of said one trapezoidal shaped closure flap;

(2) a second scoreline, initiating on said slit and terminating at a free edge of said trapezoidal shaped closure flaps.

11. The container as defined in claim 10 wherein the second scoreline initiates at the termination of said first scoreline.

12. The container as defined in claim 10 wherein said second scoreline is formed approximately perpendicular to said slit.

* * * * *